United States Patent [19]

Briggs et al.

[11] 4,081,238

[45] Mar. 28, 1978

[54] PORTABLE HEATER

[75] Inventors: Eugene C. Briggs; William C. Wellbaum; Robert F. Shaftner, all of Dayton, Ohio

[73] Assignee: Koehring Company, Milwaukee, Wis.

[21] Appl. No.: 603,038

[22] Filed: Aug. 8, 1975

[51] Int. Cl.[2] ..... F24H 3/04; B01D 33/34

[52] U.S. Cl. ..... 432/222; 431/343; 137/544

[58] Field of Search ..... 432/222, 224; 431/183, 431/203, 142, 343, 344

[56] References Cited

U.S. PATENT DOCUMENTS

| | | | |
|---|---|---|---|
| 3,239,960 | 3/1966 | Stevens | 432/222 |
| 3,256,003 | 6/1966 | Briggs | 432/222 |
| 3,301,308 | 1/1967 | Briggs | 432/222 |
| 3,694,135 | 9/1972 | Dancy et al. | 431/183 |
| 3,706,446 | 12/1972 | Briggs | 432/224 |
| 3,794,461 | 2/1974 | Brazee | 432/222 |
| 3,883,290 | 5/1975 | Windelbandt | 432/222 |

*Primary Examiner*—John J. Camby
*Attorney, Agent, or Firm*—Jerome P. Bloom

[57] ABSTRACT

A compact, relatively midget sized, portable heater a stable base for which is provided by its fuel tank per se. The tank features a plug fit filter tube formed to facilitate the connection of a fuel supply line. Preferred embodiments of the heater are characterized by plate formed air deflector fins which are arranged to most effectively control the delivery of air to and about the discharge from a simply mounted and constructed fuel nozzle at the entrance to a combustion chamber. The illustrated embodiment shows the fins as included in a bracket-type support for the fuel discharge nozzle and on a deflector plate which defines the entrance to the combustion chamber to which it mounts. The relationship of parts enable the use of a minimal amount of energy for a given application.

25 Claims, 9 Drawing Figures

PORTABLE HEATER

BACKGROUND OF THE INVENTION

This invention relates to a portable heater which is more compact in construction, more economical to fabricate, more efficient and satisfactory in use and unlikely to malfunction.

Portable heaters, particularly those which are oil burning heaters, have been the subject of much development effort. It nevertheless remains that such heaters are still characterized by difficulties in construction and/or performance, high energy cost in use, and less than desirable handling facility. For example, one of the considerable problems that still remain has been the apparent necessity for complex and expensive construction of parts designed to direct air to properly support and maintain combustion. Further, the portable space heater, particularly that which burns oil, has continued to be an unwieldly structure the low efficiency of which has necessitated sizable fuel tanks and cumbersome supports. The fuel tanks employed leave much to be desired, their construction being such to mitigate aginst a ready application and/or coupling thereto of a fuel line, let alone a fuel filter. The connections afforded in this respect are many times insecure, easily separated and subject, in short order in many cases, to leaks. Many portable oil burning space heaters, moreover, continue to emit dangerous fumes and are characterized by a requirement for frequent maintenance.

The present invention, to a substantial degree, obviates the foregoing enumerated problems which characterize the prior art "portable" space heaters, particularly those which employ oil as a fuel.

SUMMARY OF THE INVENTION

The invention enables the construction of a highly portable space heater of a relatively midget size that is half that previously contemplated as necessary for a given application.

Embodiments are characterized by a construction wherein the fuel tank is a shallow shell which per se forms the heater base and mounts a motor, compressor and fan unit, as well as a simple burner and combustion chamber, in an extremely stable and compact arrangement. The arrangement is such to enable ready portability and to minimize the chances of damage to parts in the course of the usual rough handling to which such units are normally subjected. In addition to its unusual configuration the fuel tank features an outlet enabling a plug fit therein of an improved filter unit which embodies a connector device facilitating a quick and extremely secure coupling thereto of a supply line.

A preferred embodiment of the invention features a portable heater wherein the means defining the combustion chamber embodies, at the entrance thereto, a deflector plate which is centrally apertured for delivery therethrough of a spray of atomized fuel and per se embodies simple and economical fin means to control and induce a flow of air in and about the issuing fuel in a manner to facilitate optimal combustion conditions.

A preferred embodiment of the invention is further characterized by the deflector plate at the entrance to the combusion chamber supporting the fuel discharge nozzle through the medium of a connected bracket which per se embodies fin means to control the movement of air about the discharging fuel and cooperates to this end with the fin means mounted directly to the deflector plate, in a manner to optimalize the combustion of fuel in the combustion chamber and, where required, in the afterburner chamber associated therewith.

Embodiments of the invention also feature a simplified fuel nozzle and mount thereof and/or improved air flow means which minimize the energy requirements for drive thereof.

It is accordingly a primary object of the invention to provide a portable heater characterized by a high degree of efficiency, low energy requirements, ease of handling and minimal requirements for maintenance.

A further object of the invention is to provide means for control of air flow in a portable heater which renders it more economical to fabricate and more efficient in its production of heat.

Another object of the invention is to provide a simple mount for a fuel nozzle in a portable heater.

An additional object of the invention is to provide means enabling a compact, relatively midget sized, heater which can perform equally as well, to the extent of its total fuel capacity, as one having twice its fuel capacity.

Another object of the invention is to provide an extremely stable mount and construction for a portable heater which makes it more resistant to damage in use and handling thereof.

A further object of the invention is to provide a portable heater and improved components therefor possessing the advantageous structural features, the inherent meitorious characteristics and the means and mode of use herein described.

Another object of the invention is to provide, for portable space heaters, a fuel tank of unusual design and characterized by an outlet in which is plug fit a unique filter unit which embodies an improved means for coupling a supply line to the tank.

With the above and other incidental objects in view as will more fully appear in the specification, the invention intended to be protected by Letters Patent consists of the features of construction, the parts and combinations thereof, and the mode of operation as hereinafter described or illustrated in the accompanying drawings, or their equivalents.

Referring to the drawings wherein one but not necessarily the only form of embodiment of the invention is illustrated, FIG. 1 is a perspective view of a compact portable heater in accordance with the invention;

Like parts are indicated by similar characters of reference throughout the several views.

Figure 1:
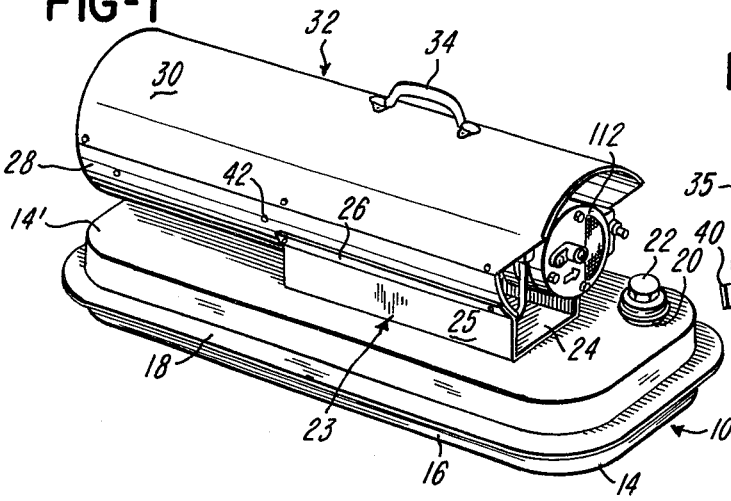

The base of the heater illustrated is a tank 10. The latter is a generally rectangular shell comprised to two identical, very shallow, tray shaped segments, each of which has a rectangular plate-like base 14 rimmed by and recessed with respect to a peripheral upstanding wall structure 16. The projected extremity of the wall 16 has an outwardly projected flange 18 oriented in a plane which is generally parallel to that of the base 14. In assembly, one tray segment is inverted over the other and their flanges 18 are coextensively abutted and welded together. The plate-like base of the one tray which is uppermost and forms the top of the tank is identified in the drawings by the numeral 14' and provided in one corner thereof (rear) with an aperture rimmed by a short tubular and perpendicularly projected, externally threaded, wall structure defining a filler tube 20. The entrance to the filler tube 20 is normally covered by a conventionally engaged closure cap 22. The top of the tank 14' also includes an outlet opening rimmed by an inwardly and convergently flared plate portion 15.

An elongate plate structure 23, formed to have a generally U-shaped configuration in transverse section, has the base 24 thereof welded to the uppermost surface 14' of the tank 10, so as to be centered between its sides and offset towards the rear end thereof. The uppermost edge portions 26 of the side walls 25 of the plate structure 23 are arranged to diverge and to provide a seat for a plate 28 which has a generally hemi-cylindrical shape. The plate 28 extends from the rearmost end of the support defined by plate structure 23 to the remote forward end of the tank 10, is suitably anchored to the edge portions 26 of the support structure and has a generally rectangular cut-out 29 at its rearmost end. A second generally hemi-cylindrical plate structure 30 is positioned over, slightly overlapped, and suitably coupled to the plate structure 28 to form therewith a tubular shell-like housing 32 having a cylindrical shape. In the embodiment illustrated the overlapped portions of plates 28 and 30 are interconnected by bolts and nuts. Connected to the housing 32 at its top and generally centered with respect to the underlying tank 10 is a strap-like luggage type carrying handle 34.

A further shell-like tubular structure 35 is mounted within and in spaced concentric relation to the forwardmost portion of the housing 32. Located interiorly of and in spaced concentric relation to the shell 35 is a further tubular shell 36 which defines the peripheral wall of a combustion chamber 38. The shell structure 35 is fixed in connection with the outer shell forming the housing 32 by eight bracket-like supports 40, one end of each of which is welded to the outer surface of the shell 35 and the other end of each of which is offset and connected to the housing 32 by a rivet 42.

Mounted in transverse bridging relation to the innermost shell 36 at its outermost end is a baffle plate 44 having a central aperture 46 rimmed by a forwardly and convergently flared plate portion 48. The baffle plate 44, at the portion thereof which lies within the boundary of the shell 36, is recessed so the forwardly projected end of its flared portion 48 lies, essentially, in a plane commonly occupied by the forwardmost end of the shell 36. The outer peripheral portion of the baffle plate 44 has a stepped, cupped configuration, providing a peripheral wall portion 50 which nests in and bears on the inner wall surface of the shell 36 at its forwardmost end, beyond which the baffle plate 44 has right angled finger-like portions 52 which project to bridge the space between the shell structures 36 and 35 and have their outermost ends bear against the inner surface of the outer end portion of the housing 35 and be connected thereto by rivets.

The baffle plate 44 is substantially capped by a cone-shaped deflector plate 56. The peripheral edge of the deflector 56, which lies within and in closely spaced concentric relation to the baffle wall portion 50, has radially projected fingers 58. The fingers 58 position in overlying relation to portions of the fingers 52 and are suitably anchored thereto, whereby to fix the deflector plate in its required position, in which it defines a cone-shaped afterburner chamber 60 with the baffle plate 44. The chamber 60 is provided with exit openings by reason of the spacing of the base peripheral edge of the deflector 56 from the baffle wall portion 50.

The rearmost end of the shell 36 is transversely bridged by a plate 62 having a central aperture 64 which is axially aligned with the aperture 46 and similarly rimmed by a forwardly and convergently flared portion 65 of the plate 62. The outer peripheral edge of plate 62 is stepped to provide a portion 66 thereof in bearing nested relation to the rearmost end of the inner wall of the shell 36, beyond which right angled radially projected, circumferentially spaced, finger-like plate portions 68 bridge the space between the rearmost end portions of shells 35 and 36 and have their outermost ends bent to bear on the inner surface of shell 35 and be connected thereto by rivets 70.

Figure 5:
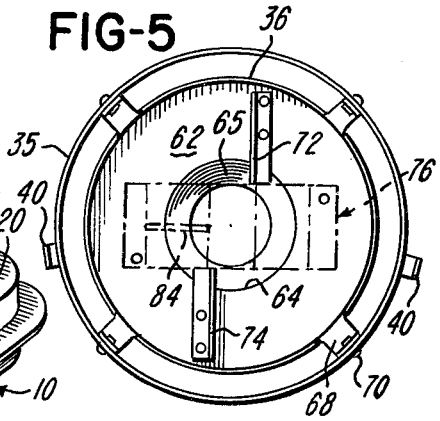
FIG. 5 is a view of the heater portion which defines the entrance to its combustion chamber.
Figure 2:
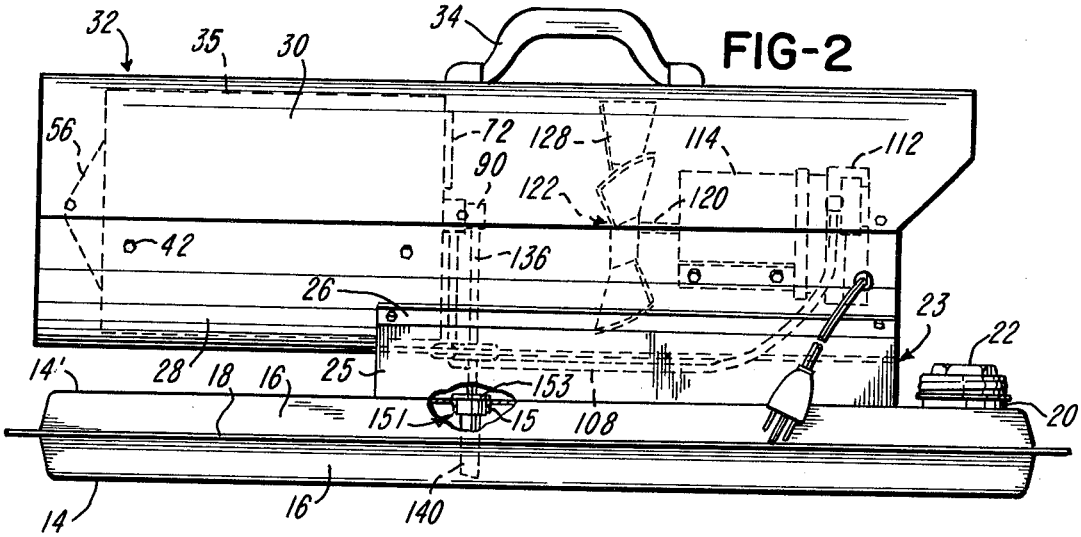
FIG. 2 is a side elevation view thereof.
Figure 3:
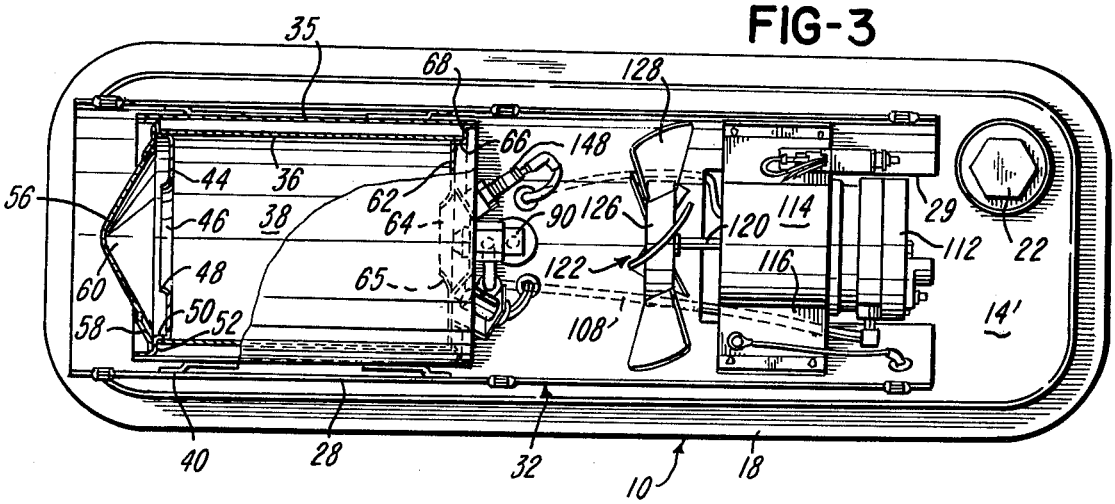
FIG. 3 is a top view thereof.
Figure 4:
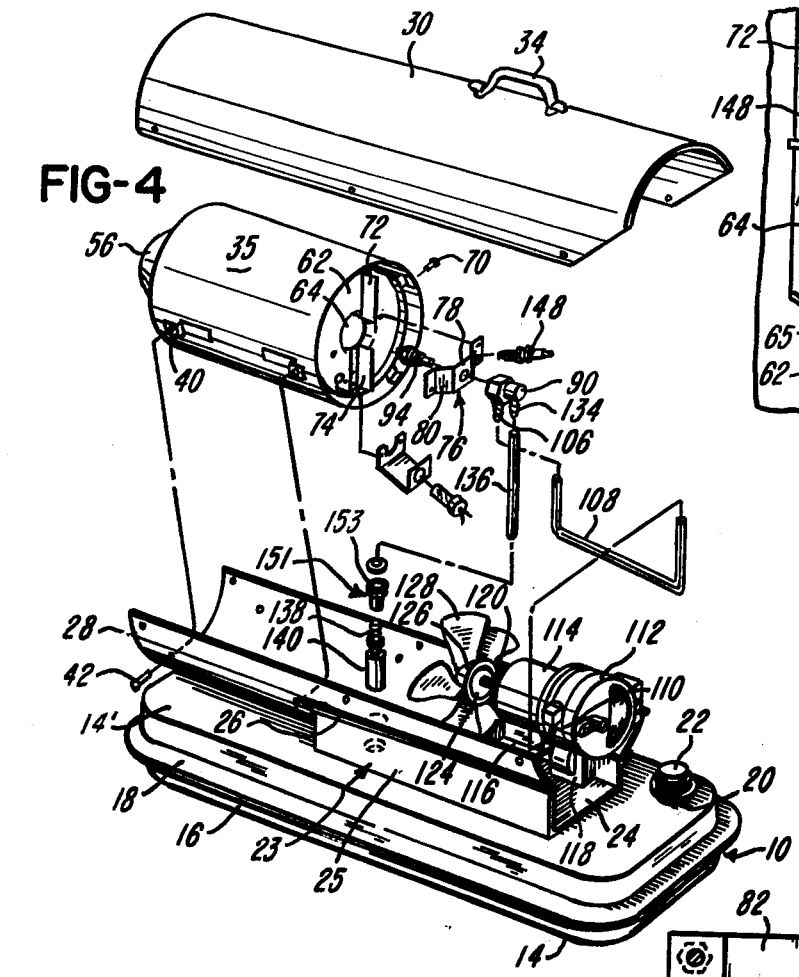
FIG. 4 is an exploded view of the portable heater.
Figure 7:
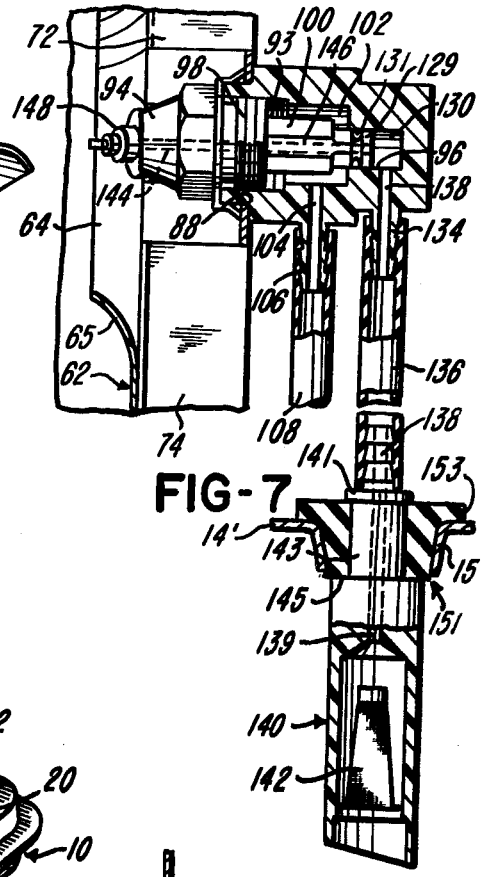
FIG. 7 is a fragmentary view, in vertical section, showing details of the fuel nozzle and associated structure included in the illustrated embodiment of the invention.
Figure 6:
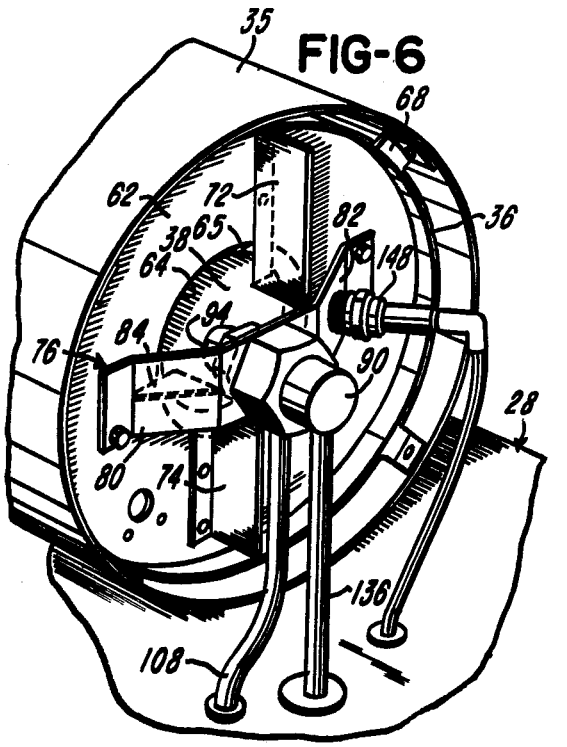
FIG. 6 is an enlarged fragmentary view illustrating structure embodied at the entrance to the combustion chamber.
Figure 9:
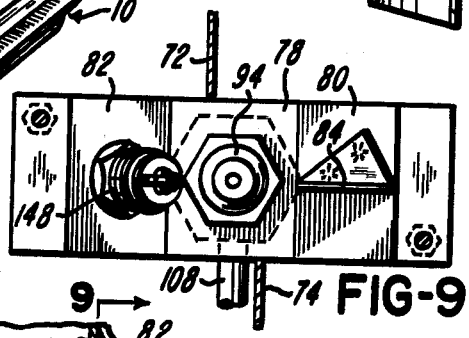
FIG. 9 is a view taken on line 9—9 of FIG. 8.
Figure 8:
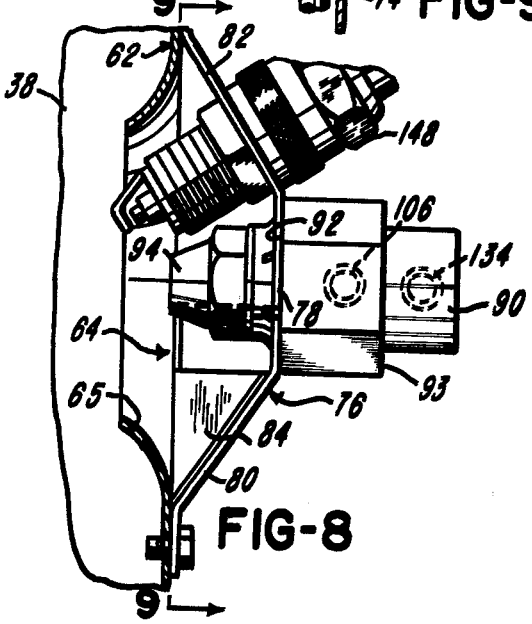
FIG. 8 is a top view of the mounted fuel nozzle.

Fixed to the rearmost surface of plate 62, in its upper right hand quadrant as seen in FIG. 5 of the drawings, is a bracket providing thereon a plate-like air deflector 72 arranged to form a generally rectangular fin which projects rearwardly of the plate 62 in a line located in adjacent and spaced parallel relation to the vertical center line of the plate 62. A similar plate-like air deflector is fixed to form a generally rectangular fin 74 which projects from the rearmost surface of plate 62 in the lower left hand quadrant thereof, in an adjacent and spaced parallel relation to the vertical center line of the plate 62. As thus disposed the upper and lower air deflectors or fins 72 and 74 have a symmetrical orientation in a diametral sense.

The adjacent ends of the fins 72 and 74, which are vertically spaced, project inwardly of the opening 64 outlined by the base and to the extent of the inner radial limits of the flared portion 65.

Further fixed to the rearmost face of the plate 62, intermediate the adjacent vertically spaced ends of the air deflectors 72 and 74 is a horizontally oriented strap-like element providing a bracket 76. The respective ends of the bracket 76 seat on and are fixed to the plate 62 while the portion thereof intermediate its ends is configured to form a bridge across the aperture 64 and outline, with the adjacent face of the plate 62, a trapezoidal space. The apex of the bridge is defined by a short strap portion 78 from which the equal leg portions 80 and 82 of the bridge diverge as they extend towards the plate 62. Fixed to the inner surface of the leg portion 80 is an air deflector fin 84 which has the configuration of a right triangle the hypotenuse of which is formed by the leg 80. The fin 84 orients in a plane perpendicular to the rearmost surface of the plate 62, which its outer radial portion abuts, and radial to its center. The inner radial portion of the fin 84 projects radially inward of the base of the flared portion 65, similar to the radial innermost ends of the fins 72 and 74.

Located centrally of the strap portion 78 of the bracket 76 is an aperture 88 which is axially aligned with the aperture 64. The aperture 88 accommodates the insertion therein of one end of an integrally formed nozzle adapter 90. Immediately to the rear of the inserted end thereof, the outer periphery of the adapter 90 is formed with a radially expanded portion to define thereon a pair of longitudinally spaced radial shoulders 92 and 93. In the insertion of the one end of adapter 90 in aperture 88, the shoulder 92 is caused to abut the rearmost face of the bracket portion 78. The end of the adapter 90 which is inserted in the strap portion 78 is bored and counterbored to produce in the forwardmost end thereof an expanded socket portion 93, the peripheral wall of which is threaded for the threaded engagement therein of the body of a nozzle 94, and in the rearmost end a reduced diameter cylindrically shaped pocket 96.

As seen in the drawings, the nozzle 94 is shown as a siphon type nozzle the base of the conical head 96 of which abuts the face of the strap portion 78 most adjacent the plate 62 as the adjacent externally threaded body portion 98 thereof is threadedly engaged to the wall of the socket defining portion 93 of the adapter 90. The interconnection of the nozzle to the adapter clamps these two elements to the strap portion 78 in a manner believed obvious, with, if desired, suitable washers being interposed therebetween. The nozzle 94 includes, within the cavity provided by the socket portion 93, at its rearmost end, a reduced diameter thin tubular shank portion 100 to form thereabout, within the socket portion 93, an annular air chamber 102. A radial passage 104 in the radially expanded wall portion of the adapter 90 opens at its innermost end to the chamber 102 while its outermost end is axially extended by a tubular, externally barbed adapter 106 formed integral with and projected radially outward from the adapter wall. The adapter 106 serves for connection thereto of one end of a hose 108 the opposite end of which is coupled to a similar adapter 110 leading from the compression chamber portion of an air compressor 112. The latter is conventionally constructed and connected as an axial extension of the rearmost end of a motor 114 and its rotor is conventionally connected to and driven by an extension of one end of the motor drive shaft 120. The motor 114 is mounted on a bracket type plate 116 which is horizontally disposed to bridge the rear end portion of the plate 28 which provides the lower half of the shell-like housing 32. For compact installation a transformer 118 is fixed in a suspended relation to the underside of the plate 116 and depends through the cut-out 29 in the plate 28. Fixed to the forwardmost end of the motor drive shaft 120 is a fan type blade assembly 122. The latter is comprised of a centrally apertured disc shaped plate 124 positioned radial to the shaft 120 having a cylindrical axially extending flange 126 integral with and extending circumferentially of its outer edge. A series of fan blades 128 are spaced circumferentially of and projected radially from the flange 126.

The rearmost end of the shank portion 100 is further reduced in diameter to provide an end portion 129 thereof which nests in the pocket 96, substantially to bear on the peripheral wall thereof. This nested portion 129 has a circumferential groove nesting in turn a resilient O-ring 131 which radially projects to resiliently bear on and form a seal between the wall and the nozzle portion 129. The rearmost end of the nozzle provided by the portion 129 terminates short of the base of the pocket 96 to form therein a fuel inlet chamber 130. A radial passage 132 in the wall of adapter 90 opens at one end to the chamber 130 while its outermost end is axially extended by a barbed adapter tube 134 formed integral with and projected radially outward from the adapter wall.

A flexible hose 136 has one end slip fit and thereby anchored to the adapter 134 while the other end thereof is projected through a grommet rimming an opening in the plate 28 to be slip fit and thereby anchored to a similar barbed tubular adapter 138. The adapter 138 is formed integral with and provides an axial extension of one end of a tube-like filter housing 140. At the base of the adapter 138 the housing 140 has a radially projected flange 141 which extends circumferentially thereof. Beyond the flange 141 and to the side remote from the adapter 138 the housing 140 has the external diameter thereof reduced in dimension to provide a peripheral surface portion 143 thereof which is relatively recessed to form a circumferential groove of short axial extent the limits of which are defined by the flange 141 and an annular shoulder 145. The housing 140 has a fuel passage 139 opening at one end thereof through the adapter 138, the opposite end of which passage is expanded to nest a conical screen-type filter 142 the base of which is suitably secured to the housing wall.

As seen in the drawings, a resilient rubber bushing 151 mounts about and in sealing relation to the relatively recessed outer surface portion 143 of the housing 140 to have its respective ends bear in the one instance against the shoulder provided by the radial flange 141 and the other instance against the shoulder 145. The outer peripheral configuration of the bushing 151 in the area thereof other than defined by the flange 153 has a diameter which is slightly greater in dimension than the outlet rimmed by the flared plate portion 15 of the tank 10. The diameter of the flange 153 is of course greater.

Particular attention is directed to the fact that the design of the filter housing 140 and its uniquely integrated adapter 138 in combination with the bushing 151 provides a filter-type connector assembly which can be readily and simply plug fit in the outlet opening of the tank 10. Due to the resilient rubber-like character of the bushing 151 and the limited diameter of the filter mounting inlet end of the filter housing 140, the inlet end of the filter housing may be freely passed through the outlet opening in the tank 10 until the flared portion 15 is encountered by the body of the bushing 151 which may then be pressed therein, as enabled by the resiliency of the bushing material, until the flange 153 is brought into an abutted sealing relation to the surface 14' of the tank 10 about the inwardly directed plate portion 15. Due to the fact that the body of the bushing 151 is not only resilient but slightly greater in outer diameter than the inner diameter of the outlet opening of the tank, as the innermost end of the bushing passes the flared plate portion 15 it will slightly expand to underlie the inner extremity of the plate portion 15. The end result is that by a simple plug fit of the assembly of the filter housing and the bushing 151 there is achieved a tightly sealed mount of the filter housing which positions its lower open end, which defines the entrance to the fuel passage 139, in a closely adjacent relation to the bottom plate portion 14 of the tank 10. It will be seen, accordingly, that the design of the tank, with reference to the provision for its outlet opening in combination with the uniquely mounted filter housing affords an improved sealed outlet adapter in connection with the tank which embodies not only a filter for the fuel to pass from the tank but an integrated coupler which insures that the hose 136 will be sealingly connected with and anchored to the tank in a manner believed obvious.

The lower open end of the filter housing 140 is cut at an angle to facilitate fuel, under the influence of suction, being drawn to and through the filter and its housing to the pocket 96 in the adapter 90. From the pocket 96 the fuel is drawn through a small bore, axial, central through passage 144 which runs the length of the nozzle 94. Formed in the outer surface of the nozzle shank portion 100 are grooves 146 which are extended by small bore passages in the head of the nozzle. The discharge ends of such passages are conventionally oriented to direct air under pressure to apply suction to draw fuel from the tank 10 through the connected filter, hose 136, pocket 96 and passage 144 to cause the fuel to be atomized and in such form discharged in a controlled spray, within the area defined about the nozzle by the flared portion 65 of the plate 62. The discharge end of the nozzle 94 preferably terminates forwardly of and immediately adjacent the base of the flared portion 65.

The strap portion 82 provides for mount of a spark plug 148 the spark gap of which positions within the forwardmost or discharge end of the flared portion 65 of plate 62.

Attention is directed to the fact that only so much detail has been here described as appears essential to an understanding of the present invention. For example since the conventional motor-compressor unit is well known, only the connections thereof to the invention structure is detailed. Similar remarks apply to the electrical connections and circuitry involved which from the foregoing are well within the understanding and capabilities of a mechanic versed in this field.

As described by way of an illustrative embodiment a highly compact, economical and most efficient heater is enabled by the invention. The tank 10 provides a very low center of gravity for the unit and an extremely stable base including a fuel inlet at a rear exposed corner forwardly of which is an elongate simply formed shallow saddle which stably seats the shell-like housing 32 and positions directly under the motor-compressor to fully bear the weight thereof. The mount of the superstructure as provided is simple to effect, balanced and secure so as to eliminate stress and strain in use and to resist damage in negligent or rough handling of the heater unit.

Further the simple manner in which the inner shells 35 and 36 and the outer shell 32 is mounted and supported and the use of the fan blades 128 only on the outer periphery of the fan unit 122 insures the maximum and most effective air flow to and about the combustion chamber 38. As may be seen, the air flow about the combustion chamber and between the shells 35 and 36 will essentially originate in a straight line flow, under pressure which is maximized by the position and nature of the blades 128.

It is even more significant that the limitation of the space between shells 35 and 36 dictates that a substantial quantity of the air delivered by the fan blades will move radially inward of the shell-like housing 32 and immediately behind the plate 62 and about the bracket 76. Control of this air is uniquely and simply effected by the simple plate-like air deflectors of fins 72, 74 and 84. It has been found in extensive tests that these economically effected deflector means, as formed and positioned, will create an optimally effective, confined swirling flow of air immediately to the rear of the plate 62 and within the opening defined by the flared portion 65 thereof. The air is so controlled by such means as to create not only a most efficient supplemental atomization of the fuel as it is discharged from the nozzle 94 but an entrainment thereof in a flow condition such that upon ignition and production of a flame optimal and most complete burning of the fuel takes place in the combustion chamber 38 defined between plates 62 and 44. The afterburner chamber as provided insures that whatever remnants of fuel remain are burned therein prior to discharge therefrom of the essentially clean remnants of the burning procedure. This maximalized usage of air provides, moreover, an optimal heating of air moving through the space between the shells 35 and 36.

A very clean heated air results, to a degree not heretofore envisioned, particularly as the same is so efficiently created in use of the invention. Contributing to this, by reason of the controlled shallow depth of the fuel tank, there is no significant change in the flame rate as the fuel runs low.

A further feature of the invention is the nature and manner of the assembly of the nozzle to its adapter, the integral and improved form and association of which enables an aspirating type fuel nozzle installation and a coupling thereto of fuel and air under pressure in a simpler and more economical fashion than heretofore provided.

As will be obvious the invention eliminates need for a special die cast burner head for control of the air flow required for the heater operation. The savings in this respect are substantial.

Note, moreover, that the total design minimizes lift requirements with reference to the fuel employed, a consequence of which is to substantially reduce the supply of compressed air required in this respect. This reduces, significantly, the load on the motor. Of course, the low speed motor, low air flow compressor makes a much quieter portable heater.

Particular attention is directed to the minimal depth of the fuel tank 10. This tank has been deliberately made broad and shallow in a manner to provide that there is essentially no appreciable variation of head pressure in the tank as the level of the fuel therein reduces from its high to its low. The net result of this is that there are no adverse effects on the fuel delivery from beginning to end of a tank of fuel. The delivery is essentially uniform and the burning rate is maintained at an essentially uniform level throughout the operation of the heater, within the limits of the capacity of its tank.

The plug-in type fuel filter in conjunction with the tank design of the invention lends yet further simplicity in creation and assembly of a portable heater. Inherent in such design is not only economy but a considerable ease of inspection and maintenance and a ready ability to insure uniform and clean fuel flow to and through the nozzle.

From the foregoing the many advantages and benefits of the invention from which significant advance in the art derives should be clear.

From the above description it will be apparent that there is thus provided a device of the character described possessing the particular features of advantage before enumerated as desirable, but which obviously is susceptible of modification in its form, proportions, detail construction and arrangement of parts without departing from the principle involved or sacrificing any of its advantages.

While in order to comply with the statue the invention has been described in language more or less specific as to structural features, it is to be understood that the invention is not limited to the specific features shown, but that the means and construction herein disclosed comprise but one of several modes of putting the invention into effect and the invention is therefore claimed in any of its forms or modifications within the legitimate and valid scope of the appended claims.

The embodiments of the invention in which an exclusive property or privilege is claimed are defined as follows:

1. A portable space heater comprising a fuel tank mounting means defining a combustion chamber having at one end thereof means defining an inlet thereto and at the opposite end thereof means defining an outlet therefrom, a strap-like structure connected with said means defining said combustion chamber to bridge the inlet thereto, said strap-like structure having the discharge end of a fuel nozzle in connection therewith and projected therefrom to said inlet, vane means in connection with said strap-like structure adjacent said inlet, additional vane means in connection with the means defining said inlet, means for directing fuel from said tank to move to and through said nozzle, means for ignition of the fuel on discharge thereof from said nozzle and means for delivering a flow of air to move to and about said nozzle under the composite influence of said vane means on said strap-like structure and said vane means in connection with the means defining said inlet whereby to produce a swirling flow of air the form of which insures an essentially complete burning of the fuel discharged from said nozzle.

2. A portable space heater as in claim 1 wherein the orientation of said vane means in connection with said strap-like structure is in a sense generally radial to said combustion chamber and intermediate said additional vane means, the latter of which comprise a plurality of vanes which are relatively spaced.

3. A portable space heater as in claim 2 wherein said additional vane means include plate-like air deflectors which are vertically oriented and vertically spaced and said vane means in connection with said strap-like structure comprise a plate-like deflector which is horizontally disposed.

4. A portable space heater as in claim 1 wherein said strap-like structure includes an apex or bridge portion, adjacent and spaced from said inlet, extended by divergent leg portions which seat on and are fixed to a plate-like structure which includes said means which defines said inlet to said combustion chamber, said strap-like structure and said plate-like structure being arranged thereby to outline therebetween a generally trapezoidal space, bridged in part by said vane means in connection with said strap-like structure.

5. A portable space heater as in claim 4 wherein said inlet is provided by an opening rimmed by a forwardly directed convergently flared portion of said plate-like structure, said strap-like structure is horizontally oriented and said vane means in connection therewith has a generally triangular configuration.

6. A portable space heater as in claim 1 wherein said fuel nozzle is coupled to an adapter which is connected in turn with means which together therewith provide said means for directing fuel from said tank to move to and through said nozzle and said nozzle and said adapter have portions thereof which respectively abut to and clamp a portion of said strap-like structure therebetween.

7. A portable space heater as in claim 6 wherein said adapter has an integral cup-like form, said nozzle has a discharge head portion to the side of said strap-like structure adjacent said inlet and successively reduced diameter portions which dispose within said adapter to form therewith an air chamber and a fuel chamber, a seal being provided to separate said air chamber from said fuel chamber within said adapter, said nozzle having a fuel flow passage opening at one end to said fuel chamber and from the opposite end from the discharge head of said nozzle and said means for directing fuel to and through said nozzle includes means defining a fuel flow line the discharge end of which is coupled directly to said adapter and to said fuel chamber and the inlet end of which is coupled to said tank.

8. A portable space heater as in claim 7 characterized in that a fuel filter unit forms part of said fuel flow line, said fuel filter unit being comprised of a tubular element having a fuel flow passage incorporating filter means and being characterized by an outer peripheral surface a portion of which includes resilient means providing for the plug fit of said filter unit in means defining an outlet opening from said fuel tank.

9. A portable space heater as in claim 8 characterized in that said means for delivering a flow of air to move to and about said nozzle includes a motor driven fan positioned on said tank, in axially spaced, axially aligned relation to said combustion chamber, said fan being comprised of a disc-like imperforate central portion including fan blades positioned on its outer periphery to insure a directed flow of air to said combustion chamber, and said means defining an outlet from said combustion chamber including a plate-like structure having a central opening in alignment with said inlet and capped in part by a conically formed plate which defines therewith an after-burner chamber.

10. A portable space heater as in claim 7 characterized by said adapter having formed integral therewith means for coupling a source of air under pressure to said air chamber and means for coupling to said fuel chamber the discharge end of said fuel flow line the remote end of which is coupled to said tank through the medium of an interposed filter unit.

11. A portable space heater as in claim 1 characterized in that said fuel tank is of such shallow depth as to provide that there is no appreciable variation in the head pressure within the tank as fuel therein drops from its high to its lowest level.

12. A fuel filter unit particularly advantageous for insertion in the means defining an outlet opening in a fuel tank of a device such as a space heater comprising a tubular unit, said unit having a fuel passage incorporating filter means and being characterized by an outer peripheral surface a portion of which embodies resilient means providing for a plug fit of said unit in said means defining said outlet opening and means to form a seal between said unit and the means defining the outlet opening in which it is plug fit and one end of said unit embodying means providing for a slip fit of a fuel supply line and anchoring means resisting displacement of the fuel supply line, once it is applied.

13. A fuel filter unit particularly advantageous for insertion in the means defining an outlet opening in a fuel tank of a device such as a space heater comprising a tubular unit, said unit having a fuel passage incorporating filter means and being characterized by an outer peripheral surface a portion of which embodies resilient means providing for a plug fit of said unit in said means defining said outlet opening and means to form a seal between said unit and the means defining the outlet opening in which it is plug fit, and said unit including a tubular body an outer surface portion of which is circumferentially grooved and engaged by a sleeve-like element which defines said resilient means.

14. A fuel filter unit as in claim 13 wherein the circumferentially grooved portion of said tubular body is provided by a circumferential groove in the outer peripheral surface of said body intermediate its ends and said sleeve-like element is a resilient sleeve anchored in said groove to form a seal about and with said body, at least a portion of said resilient sleeve being projected outwardly of said body and circumferentially thereof to provide a compressible means and form said resilient means which enables said filter unit to be plugged into and sealingly engaged with means defining an outlet opening from a fuel tank.

15. A portable space heater comprising a fuel tank mounting means defining a combustion chamber having at one end thereof means defining an inlet thereto and at the opposite end thereof means defining an outlet therefrom, a strap-like structure connected with said means defining said combustion chamber to bridge the inlet thereto, said strap-like structure having a central opening in line with the inlet to said combustion chamber, a fuel nozzle, an adapter coupled to and forming an axial extension of said nozzle, said fuel nozzle and said adapter, in the coupling thereof, being applied to have portions thereof abut relatively opposite faces of said strap-like structure whereby to clamp a portion of said strap-like structure therebetween and position the discharge end of said nozzle at and in a generally coaxial relation to the inlet to said combustion chamber, means for directing fuel from said tank and to said adapter for movement through said nozzle, means for ignition of said fuel on its discharge from said nozzle and means mounted on said tank for effecting a directed flow of air under pressure to said nozzle and said combustion chamber to insure ignition and support combustion.

16. A portable space heater as in claim 15 wherein said nozzle and said adapter are so formed that in the coupling of one to the other they define therebetween an air chamber and a fuel chamber, said fuel chamber being in line with and remote from said discharge end of said nozzle and said air chamber being intermediate said discharge end of said nozzle and said fuel chamber, a seal being provided between said air chamber and said fuel chamber, said means for directing fuel from said tank to said adapter providing for a direct connection of said tank with said fuel chamber, said nozzle having a flow passage one end of which is communicated with said fuel chamber and the opposite end of which opens from said discharge end of said nozzle and at least one passage communicating said fuel flow passage therein with said air chamber, and said means for effecting a directed flow of air includes means for directing air under pressure to said air chamber to move to and through said nozzle to draw fuel from said fuel chamber for discharge therewith in an atomized form.

17. A portable space heater as in claim 16 wherein said adapter includes lateral openings from each of said fuel chamber and said air chamber, which lateral openings are respectively defined by tube-like projections formed integral with said adapter, which tube-like projections respectively provide means for coupling thereto a line for delivering air under pressure to said air chamber and a line for directing fuel to said fuel chamber.

18. A portable space heater as in claim 17 wherein said tank has an outlet opening in which a tubular fuel filter unit is plug fit and a fuel delivery line is connected between said plug fit filter unit and the lateral tube-like projection which defines the opening to said fuel chamber to provide said means for directing fuel from said tank for movement through said nozzle, and said means for effecting a directed flow of air includes means for directing air under pressure by way of a line the discharge end of which connects with the lateral tube-like projection defining the opening to said air chamber.

19. A portable space heater as in claim 15 characterized in that said fuel tank is shallow, the depth thereof being limited to provide that there is no appreciable variation in the head pressure within the tank as the fuel drops from its highest to its lowest level within the tank.

20. A portable space heater as in claim 15 characterized in that said strap-like structure is configured to outline a generally trapezoidal space and to include an apex or bridge portion adjacent and spaced from said inlet extended by divergent leg portions which seat on and are connected to the means defining a combustion chamber, said fuel nozzle is coupled to project from said bridge portion and one of the legs of said strap-like structure has an aperture for mount therein of a spark plug or like igniter means to position the spark producing portion thereof immediately beyond the discharge end of said nozzle and within the area of said inlet.

21. A portable space heater as in claim 20 characterized in that said inlet is provided by an opening rimmed by a forwardly directed convergently flared portion of a plate-like structure which extends inwardly of said combustion chamber and said flared portion of said plate-like structure is in immediately surrounding relation to the discharge end of said nozzle and the spark producing portion of said igniter means.

22. A portable space heater as in claim 15 wherein said adapter has an integral cup-like form, said nozzle has a discharge head portion to the side of said strap-like like structure adjacent said inlet and successively reduced diameter portions which dispose within said adapter to form therewith an air chamber and a fuel chamber, a seal being provided to separate said air chamber from said fuel chamber within said adapter, said nozzle having a fuel flow passage opening at one end to said fuel chamber and from the opposite end from the discharge end of said nozzle and said means for directing fuel to and through said nozzle includes means defining a fuel flow line the discharge end of which is coupled directly to said adapter and to said fuel chamber and the inlet end of which is coupled to said tank.

23. A portable space heater as set forth in claim 22 wherein a tubular body forms part of said fuel flow line, said body has a circumferential groove in its outer peripheral surface containing a resilient sleeve anchored in said groove to form a seal about and with said body, said tubular body having formed therein a fuel flow passage, and at least a portion of said resilient sleeve being projected outwardly of said body and circumferentially thereof to provide a compressible means and enable a plug fit of said tubular body into and in sealing engagement with means defining an outlet opening from said fuel tank.

24. A portable heater as in claim 15 characterized in that said means defining a combustion chamber includes a cylindrically configured shell forming the peripheral wall thereof, a second cylindrical shell positioning in concentric spaced relation to the peripheral wall of said combustion chamber and defining therewith a passage for air to flow about and in a sense longitudinally of said peripheral wall of said combustion chamber, said means for effecting a directed flow of air to and about said combustion chamber including a motor driven fan positioned on said tank in an axially spaced relation to and axially aligned with said combustion chamber, said fan being comprised of an imperforate central portion from the outer periphery of which are projected a series of circumferentially spaced fan blades, outer portions of which are in a direct line with the passage between said spaced concentric shells.

25. A portable heater comprising a fuel tank mounting means defining a combustion chamber, said combustion chamber having an inlet thereto and an outlet therefrom, means in connection with said combustion chamber mounting a fuel nozzle and having in connection therewith means for delivering fuel from said tank to and through said nozzle, means on said tank for delivering air to and about said combustion chamber and said nozzle, means for igniting the fuel delivered from said nozzle for combustion thereof in said combustion chamber, said fuel tank per se forming the base of said portable heater and being characterized by a depth providing that there is no appreciable variation in the head pressure within the tank as the fuel therein drops from its highest to its lowest level and said fuel tank mounting on the upper surface thereof an elongated bracket which is generally U-shaped in transverse section and positioned intermediate of and spaced from the respective ends of said fuel tank, said bracket forming a base for said means defining a combustion chamber and positioning to one end thereof while the remainder thereof extends over said tank in elevated spaced relation thereto.

* * * * *

UNITED STATES PATENT AND TRADEMARK OFFICE

CERTIFICATE OF CORRECTION

PATENT NO. : 4,081,238

DATED : March 28, 1978

INVENTOR(S) : Eugene C. Briggs; William C. Wellbaum; and Robert F. Shaftner

It is certified that error appears in the above-identified patent and that said Letters Patent are hereby corrected as shown below:

On Introduction Page, after Inventors names, "all of Dayton, Ohio" is corrected to read -- all of Bowling Green, Kentucky --.

Col. 2, line 31, "meitorious" is corrected to read -- meritorious --;

line 67, "to" is corrected to read -- of --.

Col. 12, line 43 (Claim 22, line 4), delete "like".

Signed and Sealed this

*Eighth* Day of *August 1978*

[SEAL]

*Attest:*

RUTH C. MASON
*Attesting Officer*

DONALD W. BANNER
*Commissioner of Patents and Trademarks*